US011020791B2

(12) United States Patent
Joseph

(10) Patent No.: US 11,020,791 B2
(45) Date of Patent: Jun. 1, 2021

(54) CERAMIC POUR CUP ASSEMBLY AND METHOD OF FORMING SUCH AN ASSEMBLY

(71) Applicant: Hatton Designs of London Ltd, London (GB)

(72) Inventor: Uriel Joseph, London (GB)

(73) Assignee: Hatton Designs of London Ltd

( * ) Notice: Subject to any disclaimer, the term of this patent is extended or adjusted under 35 U.S.C. 154(b) by 0 days.

(21) Appl. No.: 16/739,258

(22) Filed: Jan. 10, 2020

(65) Prior Publication Data

US 2020/0222972 A1 Jul. 16, 2020

(30) Foreign Application Priority Data

Jan. 11, 2019 (GB) ..... 1900422

(51) Int. Cl.
*B22C 9/08* (2006.01)
*B22C 9/04* (2006.01)
*B22D 45/00* (2006.01)

(52) U.S. Cl.
CPC ..... *B22C 9/082* (2013.01); *B22C 9/04* (2013.01); *B22D 45/00* (2013.01)

(58) Field of Classification Search
CPC ..... B22C 9/04; B22C 9/082
See application file for complete search history.

(56) References Cited

U.S. PATENT DOCUMENTS

| | | | | |
|---|---|---|---|---|
| 6,019,158 | A * | 2/2000 | Soderstrom | B22D 18/04 164/119 |
| 9,381,569 | B2 * | 7/2016 | Vogt | B22D 18/06 |
| 2002/0124987 | A1 * | 9/2002 | Soderstrom | B22D 35/04 164/136 |

FOREIGN PATENT DOCUMENTS

| | | |
|---|---|---|
| CN | 105 710 307 A | 6/2016 |
| CN | 106424678 A | 2/2017 |
| JP | 2003 260561 A | 9/2003 |

OTHER PUBLICATIONS

UK Search Report, Appln. No. GB2000301.8, dated Jul. 8, 2020.
May 25, 2020 European Patent Office (EPO) Search Report for parallel EP Application No. 20275005.5.

* cited by examiner

*Primary Examiner* — Kevin E Yoon
(74) *Attorney, Agent, or Firm* — Craig A. Fieschko, Esq.; DeWitt LLP

(57) ABSTRACT

A pour cup assembly (10) includes a pour cup (12) of frusto-conical shape and which has an inlet end (14), of relatively larger diameter, and an outlet (16), of relatively smaller diameter. The assembly (10) also includes two yokes (18, 20) each including a body section (22) with a part frusto-conical internal profile and opposing arms (24, 26) extending laterally from the body section (22) and that lie in a common plan. Each arm (24, 26) has a bore or hole (30) therein. The body portion (22) has an external profile that is also part frusto-conical in shape and has one or more circumferential grooves (32) in its outer surface. The grooves (32) extend parallel to the arms (18, 20) and transverse to the longitudinal direction of the body portion (22). The grooves (32) in use accommodate a tie element disposed around the body portion (22) and cup (14) to hold the assembly together while the assembly (10) is subsequently coated with ceramic material to form the pour cup assembly. This is typically done at the same time as creating the investment cast around the invested pattern. The arrangement provides a pour cup assembly (10) that can be packaged and transported more efficiently and that can be handled with lifting assistance. The assembly also allows for the use of different sizes of pour cups with the same yokes, making the assembly more versatile.

18 Claims, 10 Drawing Sheets

CERAMIC POUR CUP ASSEMBLY AND METHOD OF FORMING SUCH AN ASSEMBLY

FIELD OF THE INVENTION

The present invention relates to a ceramic pouring cup assembly and to a method of forming and using such an assembly.

BACKGROUND

Ceramic pouring cups have been used in the investment casting industry as a metal receptacle since the early 1960s. The ceramic cups are fitted to wax assemblies and then ceramic shelled to provide the assembly with a hard, predefined, ceramic catch basin for molten metal. The lost wax casting process has continued to progress to larger and larger mold assemblies, where the manual handling of the molds has become difficult to accommodate.

To accommodate these increases in weight, the investment casting industry has created side handling features to allow the cup to be lifted without the need for manual handling. One solution has involved attaching tubes to the side of cups and gluing them in place with a ceramic bonding agent. An alternative method has been to place the ceramic pour cup into a wax die and then inject wax around the cup, thereby creating a lifting feature that can then be subsequently ceramic shelled. A further example has sought to mold the actual features directly onto the pouring cup. Each of these concepts has a cost associated with the additional process. In the case of tube assembly, there is an element of labour and a potential level of inaccuracy due to variability of the gluing process. In the case of injecting wax around the ceramic cup and then shelling the features, there is a level of time needed to inject the component, which utilises expensive equipment and manual labour. The process of molding the features onto the ceramic cup creates at the outset a difficulty with extra space required in the furnace for sintering and/or in the packing and transportation of the final item. All of these concepts create unwanted extra expenses that become difficult to justify in the manufacturing process of investment castings.

FIGS. 1A to 1C show a plurality of views of a standard pour cup used throughout the investment casting industry without any features for overcoming the difficulties with manual handling. FIGS. 2A to 2C show a plurality of views of a ceramic pour cup with lifting features already molded into the final part. While the pour cup of FIGS. 2A to 2C permits machine lifting of the assembly, the design of the pour cup does not lend itself to efficient handling.

SUMMARY OF THE PRESENT INVENTION

The present invention seeks to provide an improved ceramic pouring cup assembly and method of forming and using such an assembly. In particular, the present invention seeks to provide an improved pour cup for investment casting.

According to an aspect of the present invention, there is provided a pour cup assembly for use in casting, comprising a cup and at least one lifting yoke separately attachable to the cup, the yoke including a body portion and first and second arms extending laterally from the body portion, each arm including a support formation, and a coupling element provided on at least one of the pour cup and the at least one yoke for use in coupling the pour cup and at least one yoke together.

The advantage of this arrangement is that the assembly need only be formed at the time of use, allowing transportation in packed form, which can save significantly on transportation and storage costs. In the preferred embodiments a plurality of pour cups can be stacked together, which significantly reduces storage volumes, while the yokes can be flat packed together. In some embodiments, the yokes can be nested within one another, further reducing transportation and storage volumes.

The yoke or yokes could also be termed lifting extensions.

In an embodiment, the assembly comprises first and second yokes.

Advantageously, the pour cup has a frusto-conical shape and the body portion of the or each yoke has a part frusto-conical shape.

Preferably, the pour cup and the body portion of the at least one yoke have corresponding shapes so that the pour cup can abut against at least a part of the body portion of the yoke or yokes. This can optimise the connection between the pour cup and at least one yoke and the quality of the subsequent coating or shelling. However, in other embodiments, the pour cup and yoke or yokes need not be a precise match in shape.

In some embodiments, the body portion of the at least one yoke has an internal surface with at least two portions designed to accommodate different sized pour cups.

Advantageously, the coupling element is a groove on at least one of the pour cup and yoke. At least one groove is preferably provided on each of the pour cup and the at least one yoke. The grooves on the pour cup and the at least one yoke can be aligned with one another. The assembly preferably includes a tie element disposable in the groove or grooves so as to tie the pour cup and at least one yoke together.

In an embodiment, the assembly includes two yokes. The yokes can be nested within one another. Preferably, the yokes are substantially identical to one another.

In embodiments, the or each yoke has a substantially flat profile.

Advantageously, the pour cup and the or each yoke are made of the same material. Examples include ceramic material, alumina, silicate, fused silica and the like. In other embodiments they may be made of different materials. It is preferred that the pour cup and yoke or yokes have the same or similar coefficients of thermal expansion.

The use of a ceramic material, or alumina, silicate, fused silica and the like, for making the yokes gives them strength, such that they contribute to the strength of the final assembly.

According to another aspect of the present invention, there is provided a method of forming a pour cup assembly including the steps of coupling together a pour cup and at least one yoke, coating or shelling the coupled pour cup and at least one yoke with a cast material to form a unitary pour cup and yoke assembly.

Preferably, the pour cup and at least one yoke are coupled together with a tie element.

The coating may be by dipping in or spraying or showering with cast material.

The cast material may be a ceramic material, a colloidal silica, mullite zircon, fused silica or the like, used in investment casting.

Advantageously, the pour cup and at least one yoke are coated multiple times with cast material.

Advantageously, the or each yoke has a substantially flat profile.

In the preferred embodiment, there are provided first and second yokes, disposed or disposable on opposing sides of the pour cup.

The or each yoke preferably comprises a portion having a shape conforming to the shape of a part of the cup, thereby to be able to be disposed in close contact with the cup prior to attachment.

The or each yoke preferably comprises at least one lifting feature for receiving a lifting element, the lifting feature advantageously being one or two recesses or holes into which a lifting element can be located.

The invention also extends to a yoke or lifting extension as disclosed herein.

Other aspects and advantages of the teachings herein will become apparent to the skilled person from the description of the preferred embodiments that follows.

BRIEF DESCRIPTION OF THE DRAWINGS

Embodiments of the present invention are described below, by way of example only, with reference to the accompanying drawings, in which.

DESCRIPTION OF THE PREFERRED EMBODIMENTS

The teachings herein provide a novel concept of providing lifting features or elements that can be coupled to a pour cup for machine assisted handling of pour cup assemblies for investment casting. The concept aims to remove the variability of current processes and manufacturing methods, while removing significant costs in both the assembly, manufacture and transportation charges associated with such items.

Figure 3A:
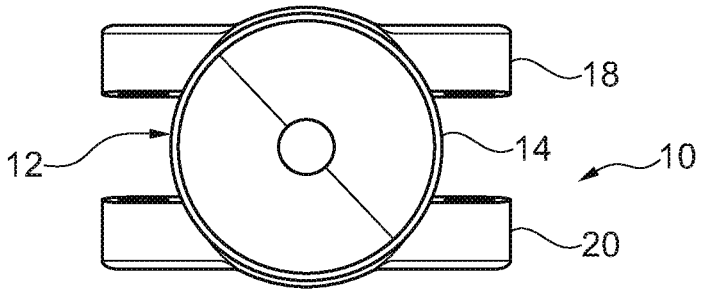
FIGS. 3A to 3D show various views of an embodiment of pour cup according to the teachings herein.
Figure 3B:
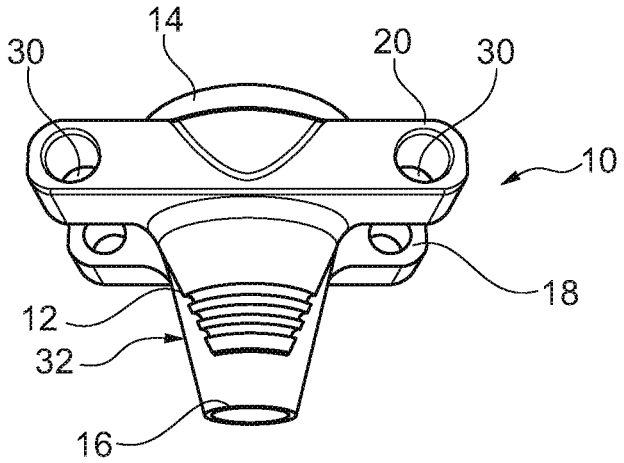

FIGS. 3A to 3B show a pour cup assembly 10, in the assembled state. The assembly 10 includes a pour cup 12 of frusto-conical shape and which is preferably similar to or the same as pour cups conventionally used in the industry. The cup 12 has an inlet end 14, of relatively larger diameter, and an outlet 16, of relatively smaller diameter. The cup 12 may have dimensions consistent with conventional pour cups used in the industry.

Figure 3C:
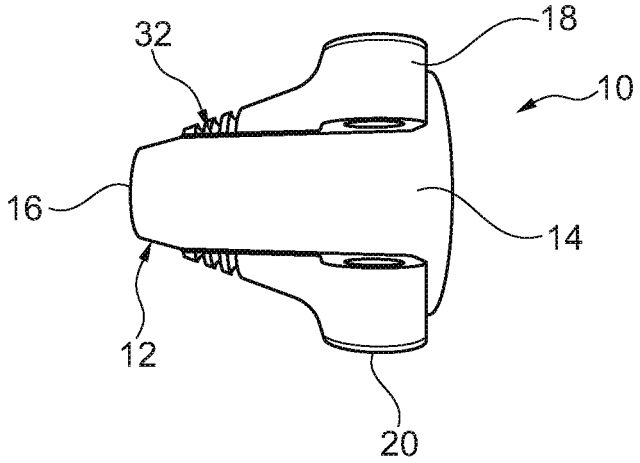
Figure 3D:
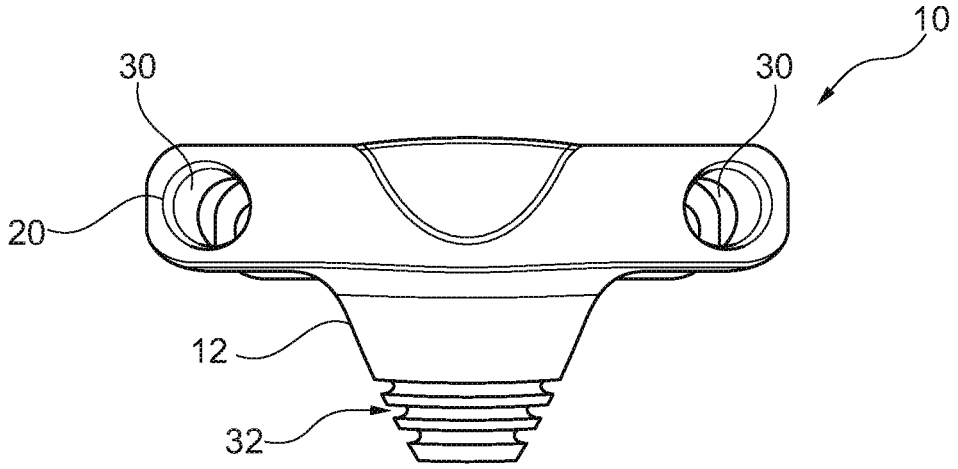
Figure 4:
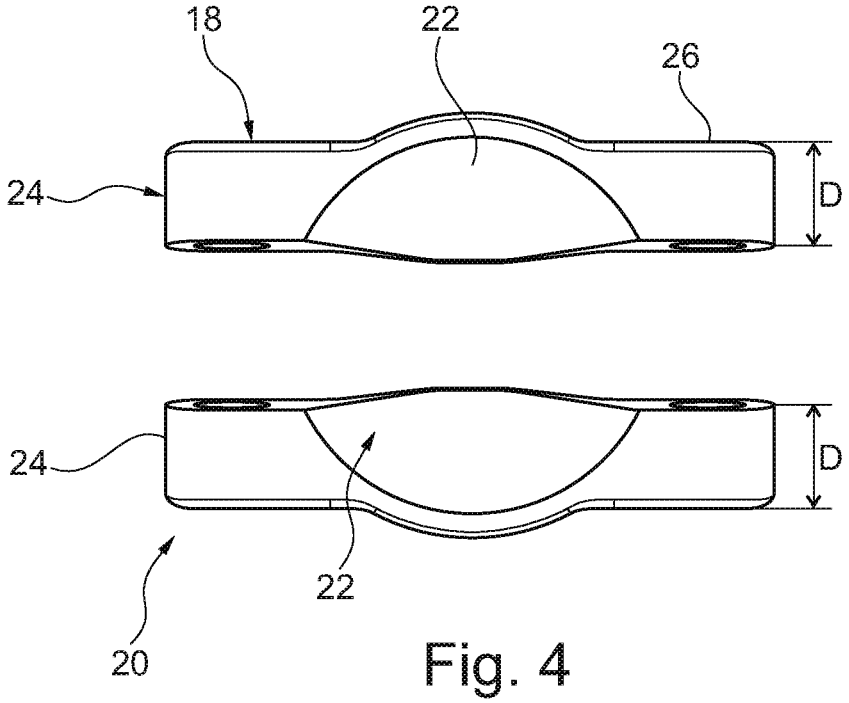
FIG. 4 is a view of the molded yokes of the embodiment of FIGS. 3A to 3D.

The assembly 10 also includes two yokes 18, 20, shown in better detail in FIG. 4. Each yoke 18, 20 includes a body section 22 with a part frusto-conical internal profile and opposing arms 24, 26 extending laterally from the body section 22 and that lie in a common plane in this embodiment. Each arm 24, 26, as can be seen better in FIGS. 3A to 3D, has a bore or hole 30 therein. The arms 24, 26 have a thickness D and have a strength sufficient to support the assembly during the manufacture of the investment cast.

The body portion 22 has an external profile that, in this embodiment, is also part frusto-conical in shape, as can be seen in particular in FIGS. 3B to 3D, and in the preferred embodiments one or more circumferential grooves 32 in its outer surface. The groove or grooves 32 preferably extend parallel to the arms 18, 20 and transverse to the longitudinal direction of the body portion 22. The groove or grooves 32 in use accommodate a tie element disposed around the body portion 22 and cup 14 to hold the assembly together while the assembly 10 is subsequently coated with cast material (typically ceramic) to form the unitary pour cup assembly. This is typically done at the same time as creating the investment cast around the invested pattern.

The assembly 10 shown in FIGS. 3A to 3D and 4 uses two yokes 18, 20 for symmetry around the pour cup 10, although in many cases a single yoke may be used, as per the examples provided below.

While the embodiments of FIGS. 3A to 3D and 4 has three grooves 32, it will be understood that only one groove is required.

There may be provided at the facing surfaces of the pour cup 12 and yokes 18, 20 an alignment feature, such as a groove and rib or other similar cooperating features. The alignment feature can ensure that the yokes are properly positioned relative to the pour cup prior to tying and coating or shelling.

It is preferred that the yoke or yokes 18, 20, as with all of the embodiments taught herein, are formed of the same material as the pour cup 10, typically a ceramic material, although other materials can be used as taught herein and known in the art. As the assembly 10 is subsequently coated in a cast or shell during the process, the yoke or yokes and the cup could be made of different materials if desired.

Figure 1A:
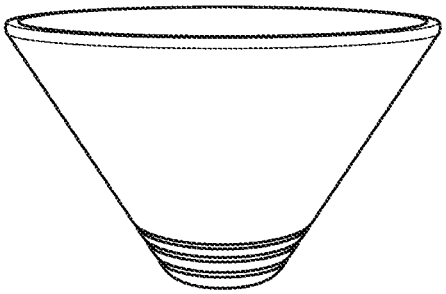
Fig. 1A PRIOR ART
FIGS. 1*a* to 1C show various views of a standard pour cup.
Figure 1B:
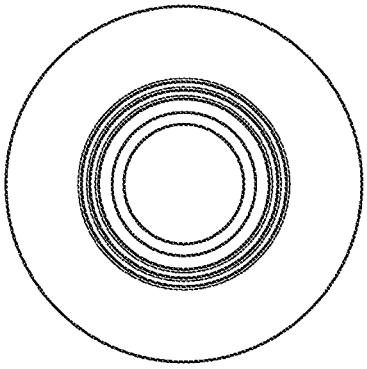
Fig. 1B PRIOR ART
Figure 1C:
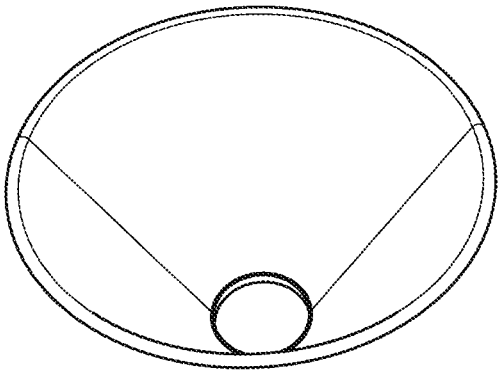
Fig. 1C PRIOR ART
Figure 2A:
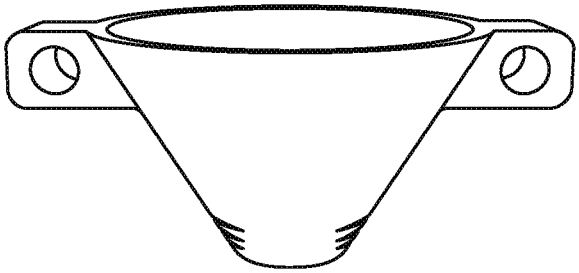
FIGS. 2A to 2C show various views of a ceramic pour cup with lifting features pre-molded into cup.
Figure 2B:
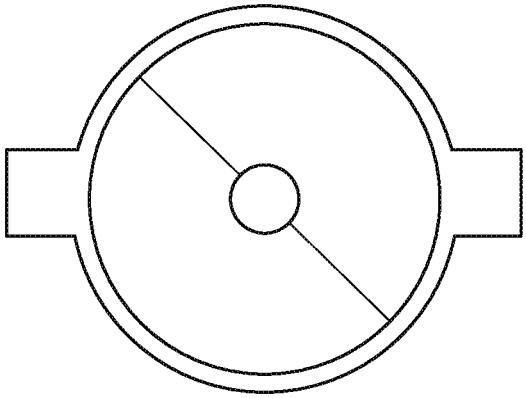
Figure 2C:
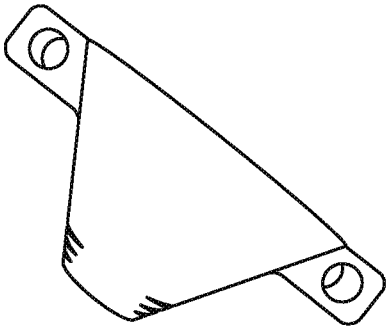

The arrangement of a pour cup 10 and separate but attachable yoke or yokes 18, 20 provides an assembly that can be handled with machine assistance, that can be reliably produced and that can be provided in an efficient manner. Specifically, the assembly can be supplied in disassembled form, packaged in a significantly lesser volume than ready assembled versions (such as that shown in FIGS. 2A and 2D), thereby significantly reducing costs. More specifically, a plurality of pour cups 12 can be stacked into one another and the yokes 18, 20 flat packed in optimised packaging. The packaging, as well as being space efficient and therefore reducing overall transportation and storage costs, can reduce the risk of damage to the pour cups and yokes/arms. A pre-molded ceramic pouring assembly with the same features would take up a significant amount of space in a transportation pallet. Depending on the size of the cup, this may reduce the available space by up to a half, thereby increasing the associated freight costs by up to two times. This new innovation allows for the individual features to be flat-packed and can reduce both valuable kiln and transportation charges potentially by over 100%.

The pour cups and yokes can be removed from the packing and tie-gripped onto the circumference of the standard pour cup design. There is no need for any special glues as the assembly will be shelled and therefore fixed into position during the standard lost wax manufacturing process.

It is to be understood that the shape and design of the yokes shown in FIGS. 3A to 3D and 4 is exemplary only and also that in some applications a single one of the yokes shown may be necessary.

Figure 5:
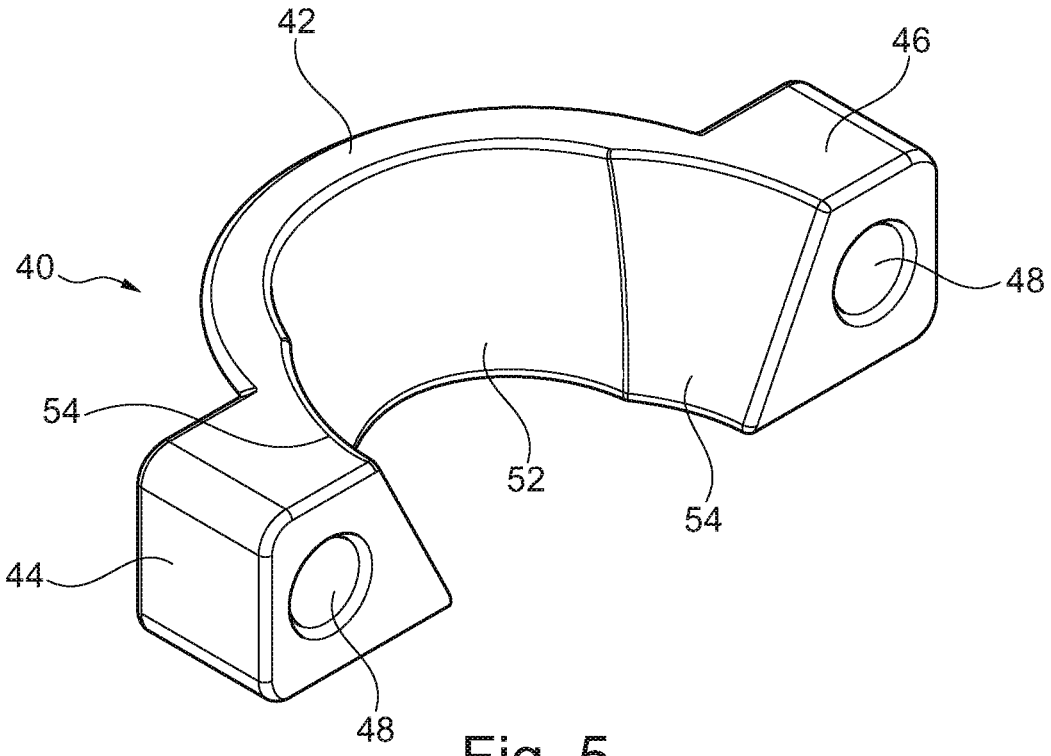
FIG. 5 is a perspective view of another embodiment of lifting yoke for a pour cup assembly.
Figure 6:
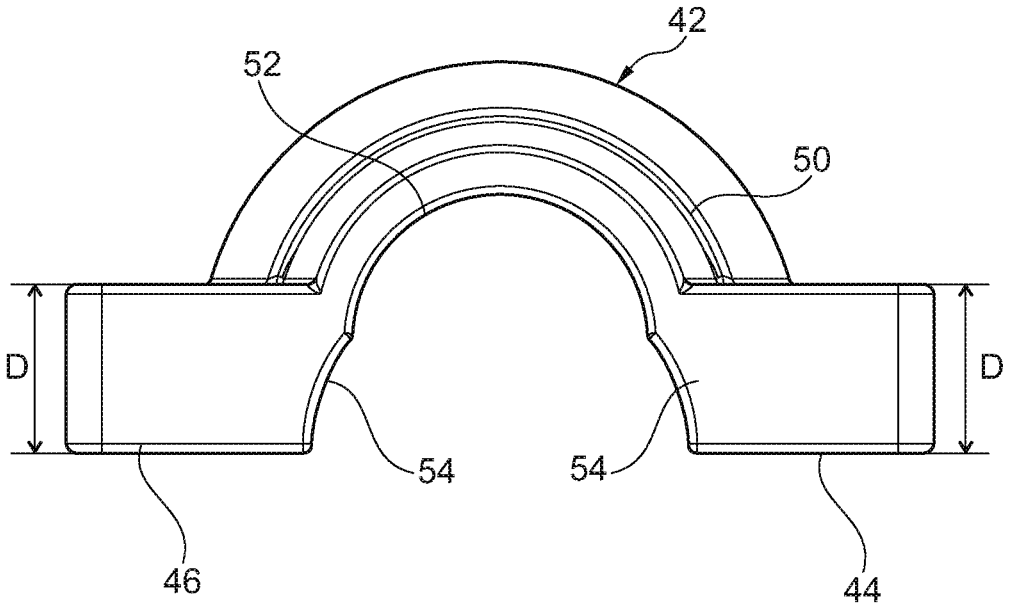
FIG. 6 is a bottom plan view of the embodiment of lifting yoke of FIG. 5.

Referring now to FIGS. 5 and 6, these show another embodiment of yoke 40 for a pour cup assembly. In this embodiment, the yoke 40 has a part frusto-conical body portion 42 and first and second side arms 44, 46 on opposing sides of the body portion 42 and lying in a common plane. Each side arm 44, 46 has a bore or hole 48 therein for accommodating a lifting rod or mandrel.

In this embodiment, the body portion has a length or depth the same as that of the side arms 44, 46. The internal surface of the body portion 42 has two sections, a first 52 having a first tapering radius and a second 54 having a second, larger, tapering radius for purposes explained below.

The side arms 44, 46 have a thickness D sufficient to be able to support the pour cup assembly on a rod or mandrel without twisting or tipping. A suitable thickness D will be dependent on the particular practical implementation and can be readily determined by a skilled person.

As can be seen in particular in FIG. 6, the outer surface of the body portion 42 is provided with a circumferential groove 50, which in this embodiment extends to the holes 48. The groove 50 can accommodate a tie element (not shown) for tying the yoke 40 to a pour cup temporarily until it is coated or shelled in an investment cast as described herein.

Figure 7:
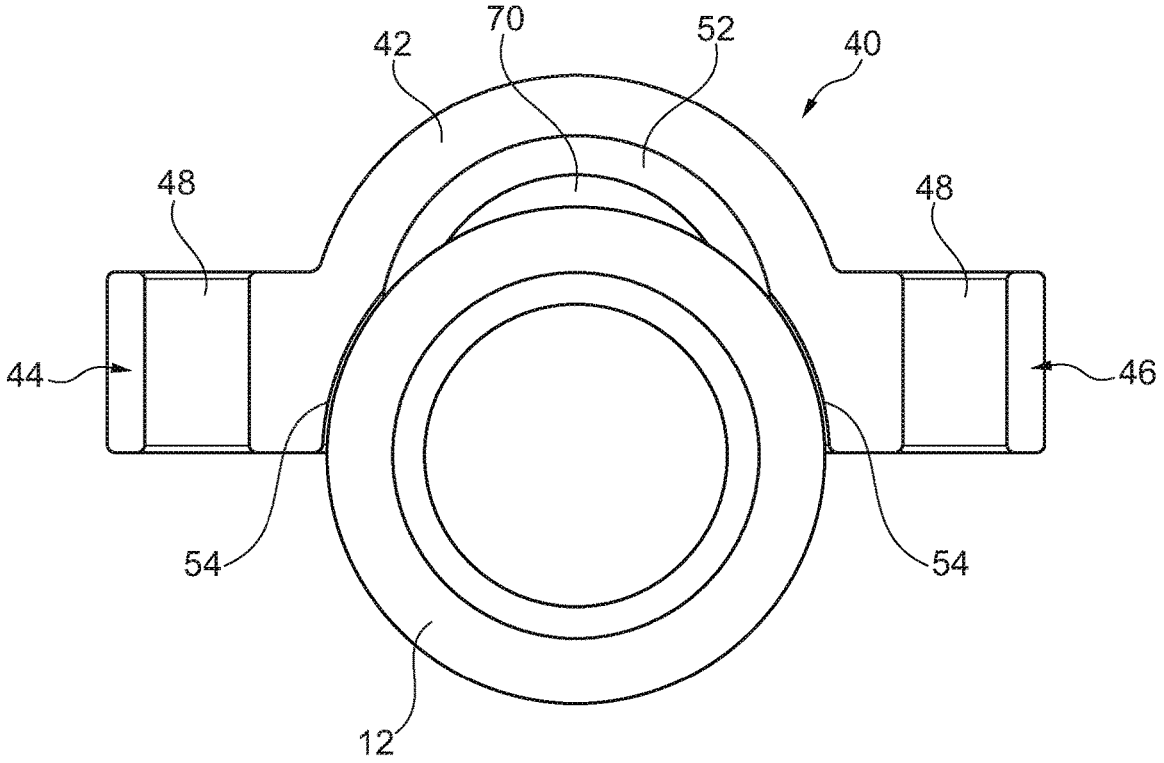
FIG. 7 is a top plan view of an embodiment of pour cup assembly using the yoke of FIGS. 5 and 6.
Figure 8:
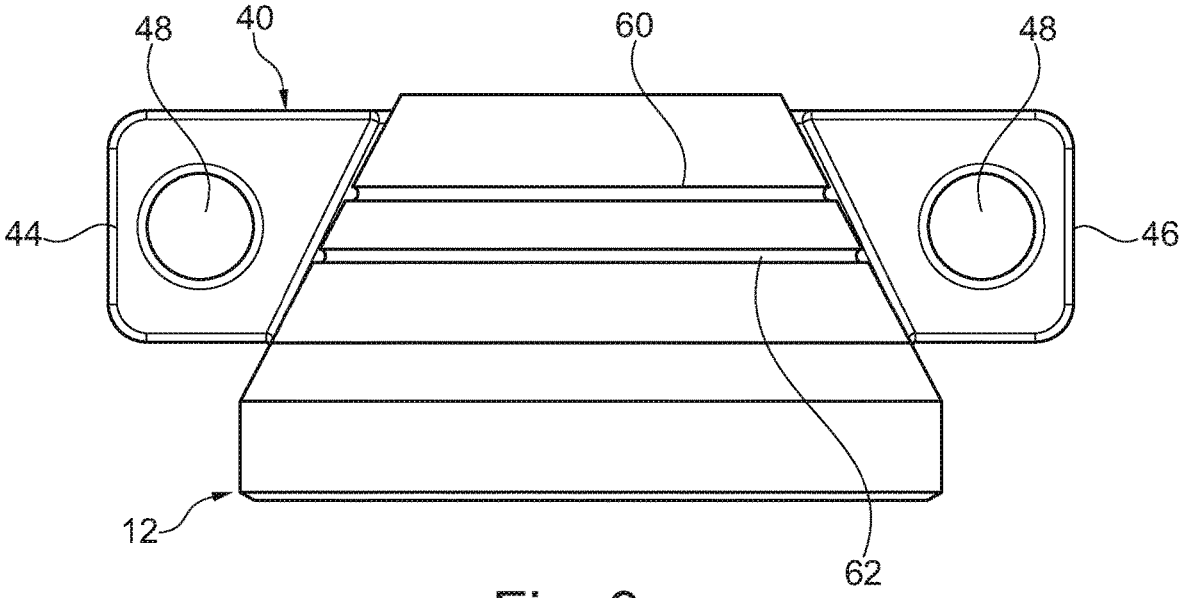
FIG. 8 is a side elevation view of the embodiment of pour cup assembly of FIG. 7.

Referring now to FIGS. 7 and 8, these show the yoke 40 coupled to a pour cup 12 of a first, larger diameter. As can be seen in particular in FIG. 7, the pour cup 12 rests against the internal, larger radius, sections 54 of the yoke 40. The cup 12 includes in this embodiment two circumferential grooves 60, 62 which can accommodate a tie element (not shown), typically around both the yoke 40 and the cup 12 and fitting within both the groove 50 in the yoke and one of the grooves 60, 62 of the cup 12. The tie element, as with any embodiment disclosed herein, can be a plastic tie, a cord, a wire or any other suitable element. The tie element can temporarily fasten the pour cup and yoke or yokes together as the subsequent coating or shelling process will form a strong and unitary assembly after which the tie element need not perform any other function. In other embodiments, the pour cup and yoke or yokes could be temporarily tied together by wax or other suitable bonding agent.

While there is a gap 70 between the cup 12 and the smaller radius portion 52 of the yoke 40, this is not material. In practice, the gap 70 will be filled with cast material during the process of making the investment cast, although if it is not this is not material as the investment cast will cover the yoke and cup at least in the portions where they touch one another, forming a strong bond between or envelope around the two components 40, 12. The gaps, however, can allow ceramic or other coating material to bond the parts together at their facing surfaces, and similarly by means of any groove 60, 62 at the interface between the pour cup and internal surfaces of the yokes.

Figure 9:
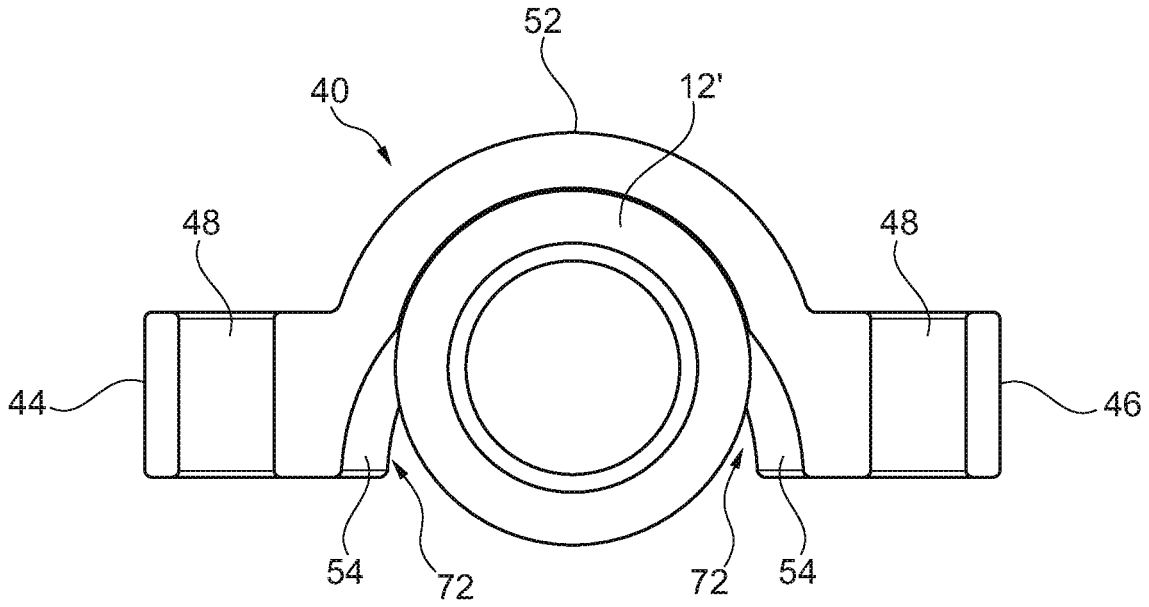
FIG. 9 is a top plan view of another embodiment of pour cup assembly using the yoke of FIGS. 5 and 6.
Figure 10:
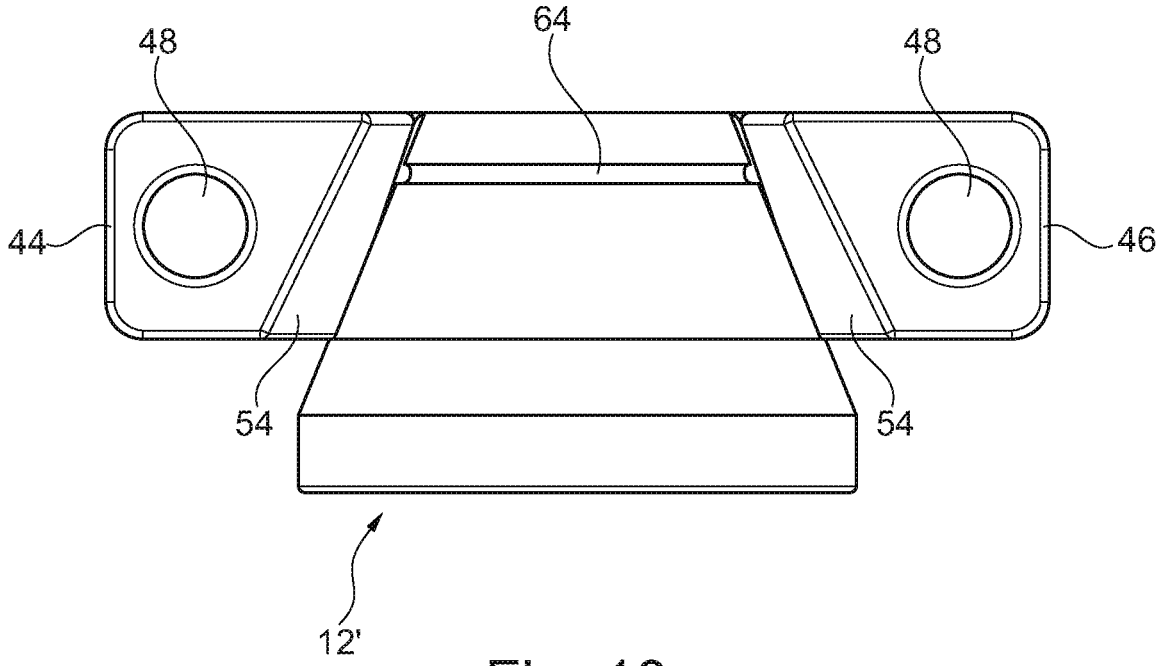
FIG. 10 is a side elevation view of the embodiment of pour cup assembly of FIG. 9.

Referring now to FIGS. 9 and 10, the same yoke 40 of FIGS. 5 and 6 is shown coupled to a smaller diameter pour cup 12'. In this arrangement, the pour cup 12' sits against the internal surface of the smaller radius section 52 of the yoke 40, with gaps 72 between the pour cup 12' and the larger radius section 54 of the yoke 40. As with the pour cup 12 of FIGS. 7 and 8, the pour cup 12' is provided with at least one circumferential groove 64 for receiving a tie element as previously described.

The embodiments of FIGS. 5 to 10 provide a single yoke 40 for the assembly. Preferably, as described, the arms 44, 46 of the yoke 40 are sufficiently wide such that a rod or mandrel fitted into the bores or holes 48 will hold the assembly without tilting on the mandrel or rod.

FIGS. 12 to 15 show another embodiment of assembly, which uses two yokes 80, one either side of a pour cup 12.

Figure 11:
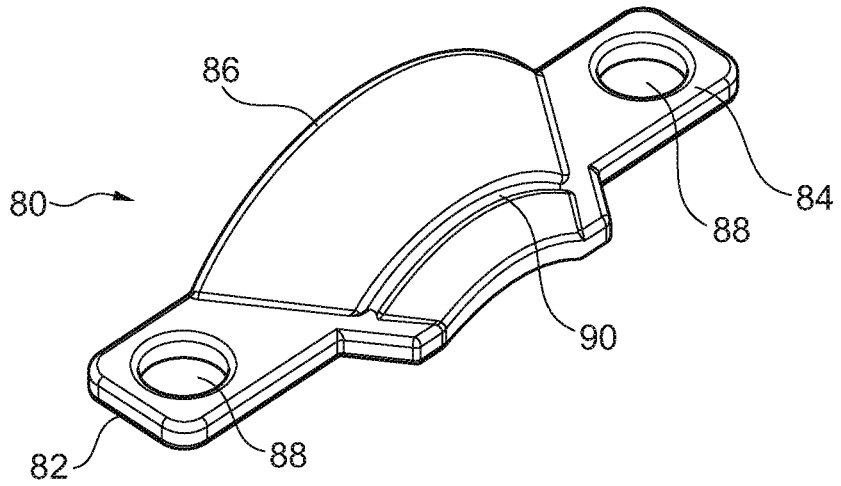
FIG. 11 is an outside perspective view of another embodiment of yoke for a pour cup assembly.
Figure 12:
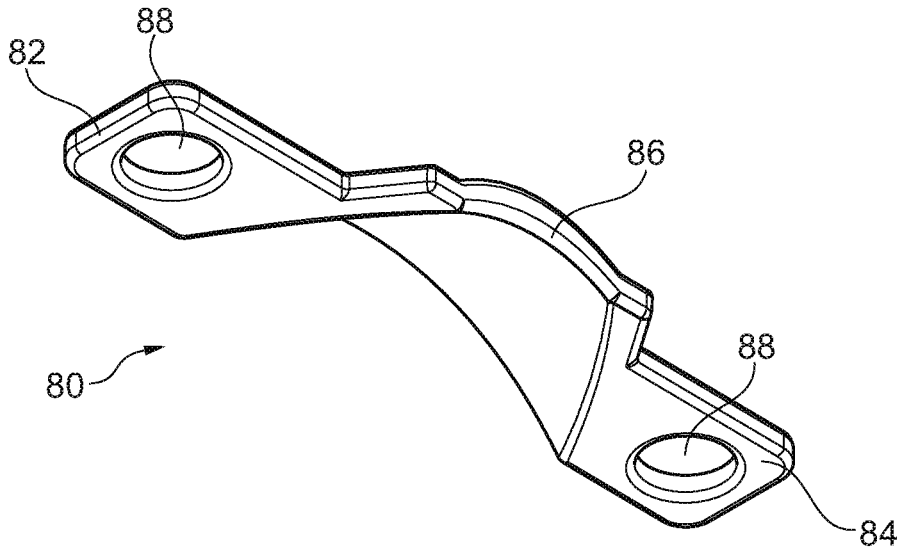
FIG. 12 is an inside perspective view of the embodiment of yoke of FIG. 12.
Figure 13:
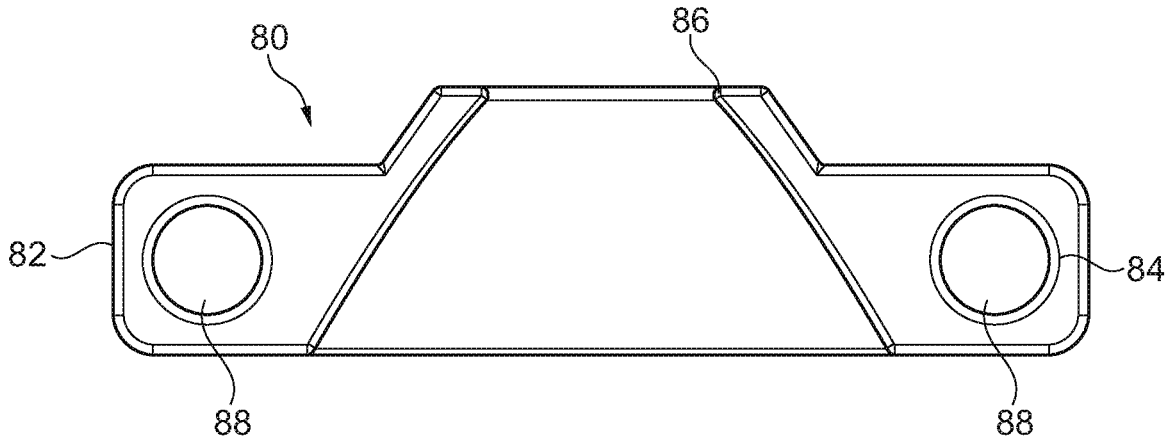
FIG. 13 is a front inside elevational view of the embodiment of yoke of FIGS. 11 and 12.

Referring first to FIGS. 11 to 13, in this embodiment the yoke 80 is formed to have a substantially uniform thickness across both its body portion 86 and its arms 82, 84. The body portion 86 is of a part frusto-conical shape and has a uniform tapering radius along its length similar to the embodiment of FIGS. 3A to 4. The body portion 86 extends further than the arms 82, 84 in the longitudinal direction, as will be apparent in the Figures.

The arms 82, 84 have a hole 88 therein similar to the other described embodiments, for receiving a lifting rod or mandrel.

An external groove 90 is provided in the outer surface of the body portion 86 and in the example shown is located just below the arms 82, 84 to as to enable a tie element to wrap around the assembly from the grooves 90 in the two yokes 80 of the assembly and below the arms 82, 84. The grooves 90 could be located elsewhere in the outer surface of the body portion, as in other embodiments.

The yoke 80 is of a shape and design that a plurality of such yokes 80 can nest within one another, substantially reducing packaging and storage requirements.

Figure 14:
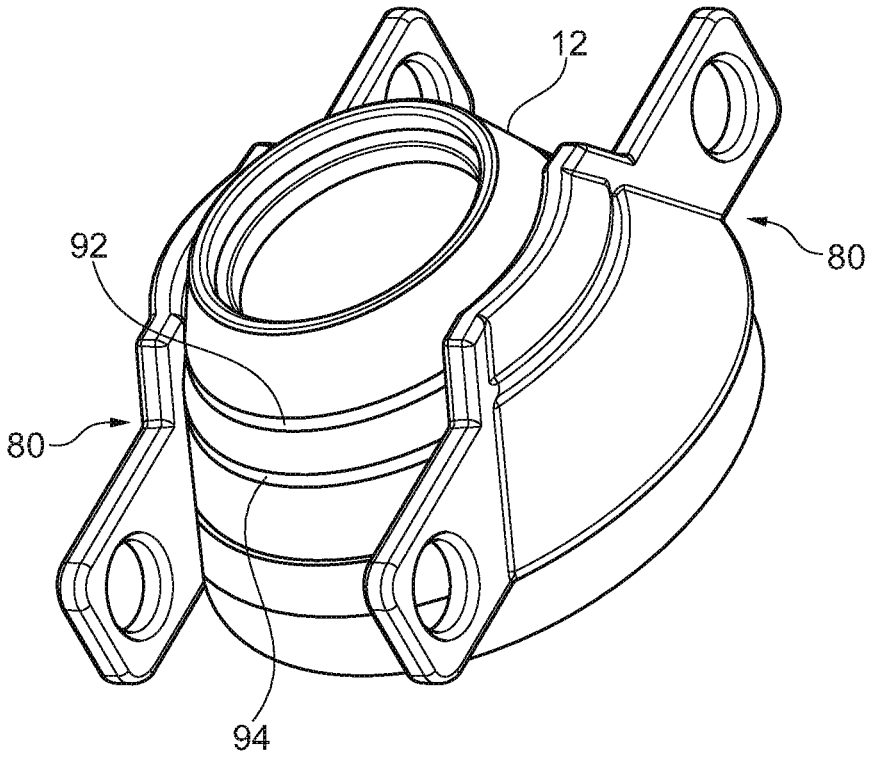
FIG. 14 is a perspective view of an embodiment of pour cup assembly using the yoke of FIGS. 11 to 13.
Figure 15:
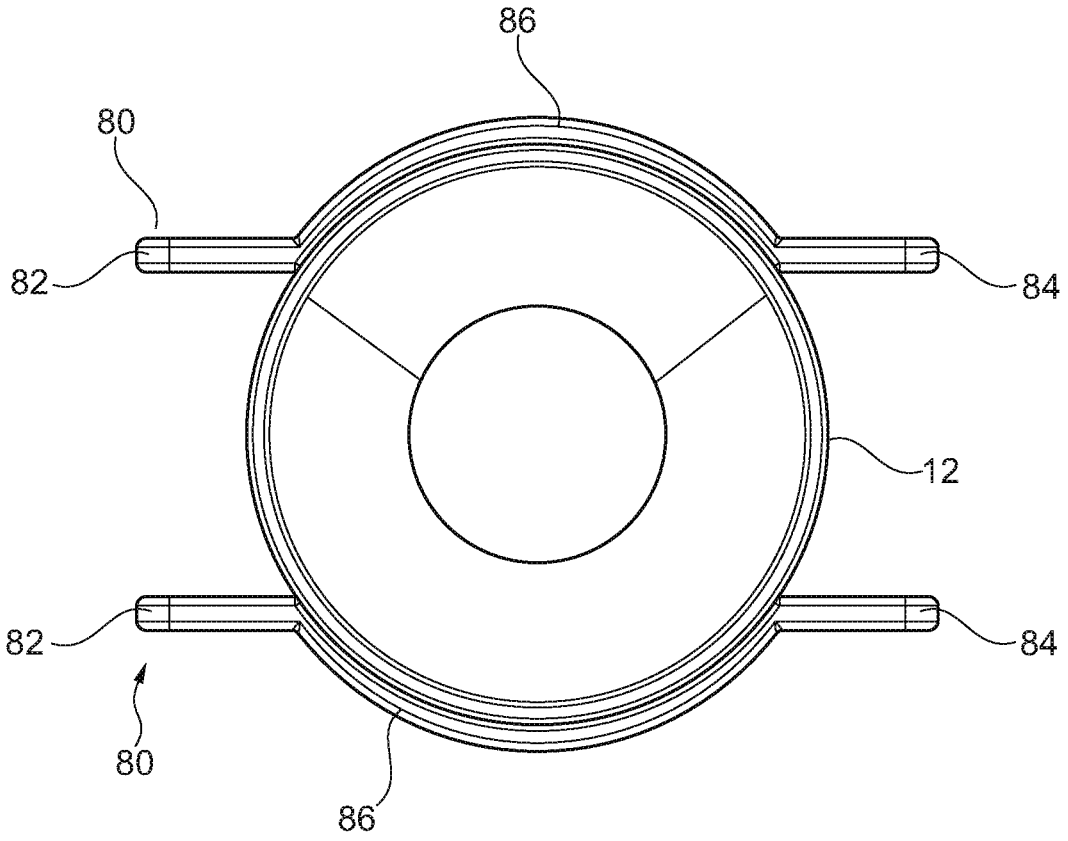
FIG. 15 is a top plan view of the embodiment of pour cup assembly of FIG. 14.

Referring now to FIGS. 14 and 15, two yokes 80 are disposed on opposite sides of a pour cup 12, provided with one or more grooves 90, 92 in its outer surface for receiving a part of a tie element. It will be apparent that when so assembled, a tie element can be disposed in the grooves 90 of the yokes 80 and also partially along the groove 92, 94 so as to hold the assembly together until it is coated or shelled.

The provision of a plurality of grooves 90, 92 on the pour cup enables the user to select the relative position of the pour cup relative to the arms 82, 84 and the holes 88, as well as the distance between the opposing yokes 80 of the assembly, determined by the taper of the pour cup 12 and how far up or down that taper the yokes 80 are disposed.

As two yokes 80 are used in this embodiment, the arms 82, 84 can be made thinner as the resistance to tilting on a rod or mandrel is achieved by the use of the two opposing and spaced arms 82, 84 of the two yokes 80.

As with the previous embodiments, the assembly is coated or shelled with cast material, typically ceramic, during the production of the investment cast, thereby forming a strong and unitary structure. The coating can be by dipping in a bath of liquid ceramic slurry or by spraying or in any other suitable manner. It will be appreciated that the holes or bores are preferably blocked off during the coating process, or otherwise cleaned after coating.

The pour cup and yokes are preferably made to fit standard production processes and machinery. In one example, the overall length (span) of the assembly is in the region of 315 mm. The thickness through the lift holes of the yokes may be in the region of 60 mm for a single yoke arrangement and around 12 mm for a double yoke arrangement. The overall height (that is height to the highest apex point) may be the region of 60 to 140 mm. The hole diameter may be in the region of 35 mm. The assembly may have a product weight of around 1.8 kgs.

While the embodiments of FIGS. 3A to 4 and 11 to 15 provide two yokes that are spaced from one another in the assembled state, it is envisaged that they may touch, that is circumscribe the full circumference of the pour cup when assembled. When spaced, the opposing yokes may have a spacing of around 125 mm between one another.

The grooves for the tie elements may have a diameter of around 9 to 10 mm but could be less or more. The grooves in the pour cups can also be used for hanging purposes.

While in the embodiments shown the arms have holes, in other embodiments the arms could be provided with a hook for the same purposes. The hook may, for instance, be inverted, that is open at its lowermost end, in the form for instance of an inverted U.

It will be appreciated that the features of the different embodiments are interchangeable with one another.

The disclosures in British patent application number 1900422.5, from which this application claims priority, and in the abstract accompanying this application are incorporated herein by reference.

What is claimed:

1. A pour cup assembly for use in casting, comprising a cup and at least one lifting yoke separately attachable to the cup, the yoke including a body portion and first and second arms extending laterally from the body portion, each arm including a support formation, and a coupling element on at least one of the pour cup and the at least one yoke for use in coupling the pour cup and at least one yoke together.

2. An assembly according to claim 1, wherein the assembly comprises first and second yokes.

3. An assembly according to claim 1, wherein the pour cup has a frusto-conical shape and the body portion of the or each yoke has a part frusto-conical shape.

4. An assembly according to claim 1, wherein the pour cup and the body portion of the at least one yoke have corresponding shapes so that the pour cup can rest against at least a part of the body portion of the yoke or yokes.

5. An assembly according to claim 1, wherein the body portion of the at least one yoke has an internal surface with at least two portions designed to accommodate different size pour cups.

6. An assembly according to claim 1, wherein coupling element is a groove on at least one of the pour cup and yoke.

7. An assembly according to claim 6, wherein at least one groove is provided on each of the pour cup and the at least one yoke.

8. An assembly according to claim 7, wherein the grooves on the pour cup and the at least one yoke can be aligned.

9. An assembly according to claim 6, including a tie element disposable in the groove or grooves so as to tie the pour cup and at least one yoke together.

10. An assembly according to claim 1, wherein a plurality of said yokes can be nested within one another.

11. An assembly according to claim 10, wherein the yokes are substantially identical to one another.

12. An assembly according to claim 1, wherein the or each yoke has a substantially flat profile.

13. An assembly according to claim 1, wherein the pour cup and the or each yoke are made of the same material.

14. A method of forming a pour cup assembly including the steps of coupling together a pour cup and at least one yoke, coating the coupled pour cup and at least one yoke with cast material to form a unitary pour cup and yoke assembly.

15. A method according to claim 14, wherein the pour cup and at least one yoke are coupled together with a tie element.

16. A method according to claim 14, wherein the coating is by one of: dipping in, spraying and showering with cast material.

17. A method according to claim 14, wherein the pour cup and at least one yoke are coated multiple times with cast material.

18. A method according to claim 14, wherein the cast material is a ceramic material, a colloidal silica, mullite zircon or fused silica.

* * * * *